US008329094B2

(12) United States Patent
Takagi et al.

(10) Patent No.: US 8,329,094 B2
(45) Date of Patent: Dec. 11, 2012

(54) MAGNESIUM ALLOY AND PROCESS FOR PRODUCING THE SAME

(75) Inventors: Toshiaki Takagi, Kobe (JP); Mamoru Nagao, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 12/934,090

(22) PCT Filed: Mar. 30, 2009

(86) PCT No.: PCT/JP2009/056442

§ 371 (c)(1),
(2), (4) Date: Sep. 23, 2010

(87) PCT Pub. No.: WO2009/123084

PCT Pub. Date: Oct. 8, 2009

(65) Prior Publication Data

US 2011/0017367 A1 Jan. 27, 2011

(30) Foreign Application Priority Data

Apr. 1, 2008 (JP) ..... 2008-095140

(51) Int. Cl.
*C22C 23/06* (2006.01)
*C22C 14/00* (2006.01)
*C22C 23/00* (2006.01)

(52) U.S. Cl. ..... 420/405; 148/557; 148/406; 148/420

(58) Field of Classification Search ..... None
See application file for complete search history.

(56) References Cited

U.S. PATENT DOCUMENTS

| | | | |
|---|---|---|---|
| 4,401,621 | A | 8/1983 | Unsworth et al. |
| 5,409,555 | A | 4/1995 | Fujita et al. |
| 6,143,097 | A | 11/2000 | Fujita et al. |
| 2004/0045639 | A1 | 3/2004 | Kikawa et al. |

FOREIGN PATENT DOCUMENTS

| | | | |
|---|---|---|---|
| CN | 1814837 | A | 8/2006 |
| CN | 101078080 | A | 11/2007 |
| EP | 1 016 477 | A2 | 7/2000 |
| EP | 1 016 477 | A3 | 7/2000 |
| GB | 2 410 033 | A | 7/2005 |
| JP | 57 210946 | | 12/1982 |
| JP | 61 250144 | | 11/1986 |
| JP | 03-002336 | * | 5/1989 |
| JP | 3-2336 | | 1/1991 |
| JP | 3-140434 | | 6/1991 |
| JP | 7-224344 | | 8/1995 |
| JP | 9 263871 | | 10/1997 |
| JP | 2001-170734 | | 6/2001 |
| JP | 2001-170736 | | 6/2001 |
| JP | 2001-294966 | | 10/2001 |
| JP | 2003-129160 | | 5/2003 |
| JP | 2004-238676 | | 8/2004 |
| JP | 2004-238678 | | 8/2004 |
| JP | 2008 075176 | | 4/2008 |

OTHER PUBLICATIONS

English translation of Harumichi et al (JP 03-002336).*
Kaya et al, Corrosion Resistance, 518-523 Met. Sci. and Heat Treat. 48:11-12 (2006).*
Yu et al, Effect of T5 and T6 Tempers on a Hot-Rolled WE43 Magnesium Alloy, 1818-1821 Mat'l Trans. 49; 8 (2008).*
RTEC, Magnesium ELETRON WE 43 (2005) at http://web.archive.org/web/20051020085116/http://www.jpx.fr/Rtec/Rtec/English/we43.htm.*
Extended European Search Report issued Feb. 1, 2011, in Patent Application No./ Patent No. 09728964.9-1215 / 2264200 PCT/JP2009056442.
Daquan Li, et al., "Effects of heat treatments on Microstructure and mechanical properties of Mg-4Y-4Sm-0.5Zr alloy", Materials Science and Engineering A, vol. 448, No. 1-2, XP005879858, (Esevier), Feb. 8, 2007, pp. 165-170.
The Japan Magnesium Association, "Handbook of Advanced Magnesium Technology", 2000, pp. 123-124 (with partial English translation).

* cited by examiner

*Primary Examiner* — Patrick Ryan
*Assistant Examiner* — Yoshitoshi Takeuchi
(74) *Attorney, Agent, or Firm* — Oblon, Spivak, McClelland, Maier & Neustadt, L.L.P.

(57) ABSTRACT

A magnesium alloy having excellent strength and elongation at high temperatures and further having excellent creep characteristics at high temperatures. Also provided is a process for producing the alloy. In producing the magnesium alloy, a magnesium alloy containing yttrium and samarium in respective specific amounts is cast and the resultant cast is subjected to a solution heat treatment, subsequently hot working, and then an aging treatment, thereby reducing the average crystal grain diameter of the structure. In addition, the amounts of the yttrium and samarium in solution in the magnesium matrix are balanced with the number of precipitate particles of a specific size in the crystal grains. The magnesium alloy thus obtained has excellent strength and elongation at high temperatures and further having excellent creep characteristics at high temperatures.

15 Claims, No Drawings

MAGNESIUM ALLOY AND PROCESS FOR PRODUCING THE SAME

CROSS-REFERENCE TO RELATED APPLICATIONS

This application is a National Stage of PCT/JP09/056442 filed Mar. 30, 2009 and claims the benefit of JP 2008-095140 filed Apr. 1, 2008.

TECHNICAL FIELD

The present invention relates to a magnesium alloy excellent in strength and elongation at high temperatures, and excellent in creep characteristics at high temperatures, and a production process thereof. Specifically, the present invention relates to a magnesium alloy suitable for a structural material such as an engine component to be used under high temperatures, a structural material to be processed and used under high temperatures, and the like, and a production process thereof.

BACKGROUND ART

In recent years, from the viewpoint of global environment, for the purpose of improving the fuel economy of vehicles such as cars, magnesium alloys have been applied to the strength members forming engines, frames, and the like. Further, the magnesium alloys have been also widely applied as structural materials of casings of electric/electronic devices, engine components (piston, connecting rod), and the like of cars, aircraft, and the like.

For use as a structural material, magnesium (Mg) has a specific gravity of 1.8, and is practically the lightest metal (with a specific gravity about ⅔ that of aluminum, and about ¼ that of iron). Further, Mg is also excellent in specific strength, specific stiffness, and thermal conductivity.

However, when a magnesium alloy is used as a structural material of vehicles and the like for use under a high-temperature atmosphere, particularly when used as a member forming an engine, the magnesium alloy is exposed to temperatures as high as 200 to 300° C. For this reason, a heat resistance within this temperature range (high-temperature strength) is required thereof.

Conventionally, there have been developed various alloys obtained by improving the creep strength of a magnesium alloy. For example, there are known heat-resistant alloys obtained by adding elements such as silicon (Si), calcium (Ca), and rare earth elements to magnesium alloys containing prescribed amounts of aluminum, zinc, and the like, and other alloys (e.g., Patent Documents 1 and 2, and many others).

All of these magnesium alloys are intended to be improved in high-temperature strength by crystallizing or precipitating intermetallic compounds of the added elements and Mg into the grain boundary. These intermetallic compound phases include Al, Si, rare earth elements, Ca, and the like, and each have a high melting point This hinders crystal grains from sliding (grainsliding) under load-bearing condition at high temperatures, resulting in an improvement of the high-temperature strength.

On the other hand, in order to provide a heat-resistant magnesium alloy which is not reduced in bolt axial tension even when used under temperatures as high as 200° C., the following is also proposed: an alloy element is dissolved in solid solution in the magnesium matrix in order to prevent the reduction of the proof stress under high-temperature environment largely affecting the bolt axial tension (Patent Document 3). More specifically, the following is proposed: an alloy element having a radius larger than that of magnesium by a given amount, and having a maximum solubility in solid solution in magnesium of 2 mass % or more is added, and is dissolved in solid solution in an amount equal to or less than the maximum solubility in solid solution for intragrain strengthening.

Then, in Patent Document 3, as these elements, specifically, there are exemplified gadolinium (Gd), dysprosium (Dy), terbium (Tb), holmium (Ho) or yttrium (Y), samarium (Sm), and the like. Whereas, as comparative examples, Ca, Al, Zn, and the like are exemplified.

Further, a magnesium alloy is a difficult-to-work material, and hence, is unfavorably not easy to form into a desirable shape. Namely, the magnesium alloy is small in solidification latent heat, and high in solidification speed. For this reason, the magnetic alloy is difficult to cast, so that the resulting castings unfavorably tend to have defects such as cavities and elephant skin. Accordingly, for products whose appearance is regarded as important, the yield is low, and the defects must be subjected to a putty treatment, unfavorably resulting in a high cost. Further, the magnesium alloy is in a close packed hexagonal structure, and hence is low in ductility. Thus, working of a sheet material or a rod material thereof by pressing or forging is required to be performed at temperatures as high as 300 to 500° C. Even when working is performed at such high temperatures, there occur problems such as a low working speed, a larger number of steps, and a shorter die life.

In order to solve such problems of the difficulty in working of the magnesium alloy, the following method is proposed: in a step of continuously casting an AZ-based magnesium alloy having an aluminum content of 6.2 to 7.6 wt %, and thereby obtaining a billet, the mean crystal grain size of the billet is set at 200 μm or less by addition of a grain refiner and/or control of the cooling rate, and the resulting one is forged to manufacture a large-size component (see Patent Document 4). This document also describes the following: after working into the final product shape, a solution treatment and a T6 heat treatment are combined, thereby to set the mean crystal grain size at 50 μm or less, resulting in an enhancement of the corrosion resistance.

On the other hand, the following method is proposed: by means of a die casting or Thixo-molding forming machine, a magnesium alloy is formed into a sheet shape; the resulting sheet material is rolled at ordinary temperature to be applied with strain, and then is heated to 350 to 400° C.; as a result, the crystal is recrystallized, so that the crystal grain size is refined to 0.1 to 30 μm, resulting in an improved ductility (see Patent Document 5). The sheet material improved in ductility is formed by press working or forging.

Further, there are also shown methods in which a sheet material of a magnesium alloy is forged and formed, and by a plurality of steps of rough forging and finish forging, a boss with a height 7 times or 10 times or less the wall thickness of the formed product main part is formed (see Patent Documents 6 and 7).

However, for forming a component in a complicated and precise shape with a magnesium alloy, the method of forging from a billet as described in Patent Document 2 has its limit in terms of shape and wall thickness. On the other hand, with the method of forming from a sheet material of a magnesium alloy as described in Patent Documents 5, 6, and 7, production of a thin-walled component is possible. However, it is difficult to obtain a formed product in a complicated and precise shape by press working or forging of the sheet material.

In contrast, in recent years, also on a magnesium alloy, elucidation of the mechanism of expression of superplasticity has been pursued as with an aluminum alloy. This indicates the possibility of allowing working at a high strain rate by refinement of the crystal grain size (see, e.g., Non-Patent Document 1).

[Patent Document 1] JP-A-2004-238676
[Patent Document 2] JP-A-2004-238678
[Patent Document 3] JP-A-2003-129160
[Patent Document 4] JP-A-7-224344
[Patent Document 5] JP-A-2001-294966
[Patent Document 6] JP-A-2001-170734
[Patent Document 7] JP-A-2001-170736
[Non-Patent Document 1] p. 119 to 125, "Handbook of Advanced Magnesium Technology" edited by The Japan Magnesium Association

DISCLOSURE OF THE INVENTION

Problems to be Solved by the Invention

However, even with these prior-art technologies, no magnesium alloy has been implemented which have both of the characteristics of strength and elongation at high temperatures, in other words, the excellent high-temperature strength and the excellent hot workability. Namely, for example, there has not yet been implemented such a magnesium alloy as to exhibit a tensile strength of 200 MPa or more, and an elongation of 20% or more upon undergoing a tensile test at 250° C. Further, there has also not yet been implemented a magnesium alloy which has these characteristics, and further, is excellent in creep characteristics at high temperatures.

The present invention was completed in order to solve such problems. It is an object of the present invention to provide a magnesium alloy which has both of an excellent high-temperature strength and an excellent hot workability, and further has an improved creep characteristics at high temperatures, and a production process thereof.

Means for Solving the Problems

In order to attain this object, the gist of the magnesium alloy of the present invention resides in that a magnesium alloy includes Y: 1.8 to 8.0 mass %, and Sm: 1.4 to 8.0 mass %, respectively, and the balance being Mg and inevitable impurities, in which the Y and Sm solute contents in the magnesium matrix are Y: 0.8 to 4.0 mass % and Sm: 0.6 to 3.2 mass %, respectively; the mean crystal grain size of the magnesium alloy structure is within the range of 3 to 30 μm; and in the crystal grains, precipitates with a diameter of 2 nm or more in the observation under a TEM of a magnification of 300000 times are present in a density of 160 precipitates/$\mu m^2$ or more on the average.

Herein, it is preferable that, quantitatively, the magnesium alloy of the present invention exhibits a tensile strength of 200 MPa or more and an elongation of 20% or more when the magnesium alloy is subjected to a tensile test at 250° C. Further, it is preferable that the magnesium alloy is subjected to a solution treatment after casting, is formed into a prescribed shape by hot working, and is further subjected to an ageing treatment.

With the solution treatment and the hot working, the Y and Sm solute contents and the mean crystal grain size of the structure can be attained. Further, with the ageing treatment, the number of precipitates in the crystal grains can be ensured, so that the creep characteristics at high temperatures can be improved.

Further, in order to achieve the foregoing object, the gist of the process for producing a magnesium alloy excellent in creep characteristics at high temperatures of the present invention, resides in the following steps: casting a magnesium alloy molten metal including Y: 1.8 to 8.0 mass %, and Sm: 1.4 to 8.0 mass %, respectively, and the balance being Mg and inevitable impurities; after the casting, performing a solution treatment at a temperature of 450 to 550° C.; after the solution treatment, performing hot working at a temperature of 350 to 550° C. for formation into a prescribed product shape; further performing an ageing treatment at a temperature of 150 to 300° C.; setting the Y and Sm solute contents in the magnesium matrix of the resulting magnesium alloy formed product structure at Y: 0.8 to 4.0 mass and Sm: 0.6 to 3.2 mass %, respectively; setting the mean crystal grain size of the magnesium alloy structure within the range of 3 to 30 μm; and allowing precipitates with a diameter of 2 nm or more in the observation under a TEM of a magnification of 300000 times to be present in a density of 160 precipitates/$\mu m^2$ or more on the average in the crystal grains.

Advantageous Effect of the Invention

The present invention is characterized in the following: In a magnesium alloy ingot including Y and Sm both as alloy elements, portions of included Y and Sm are not positively crystallized or precipitated as intermetallic compounds at the grain boundary as in the prior art, but are dissolved in solid solution in the magnesium matrix. As a result, the strength and elongation at high temperatures are improved. On the other hand, the present invention is characterized in that the remaining portions of the included Y and Sm are precipitated as precipitates in the magnesium crystal grains, thereby to ensure the number (mean number) of precipitates in the crystal grains. As a result, the creep characteristics at high temperatures are improved.

The present invention is identical with the Patent Document 3 in that portions of alloy elements such as Y and Sm are dissolved in solid solution. However, in Examples of the Patent Document 3, for the magnesium alloy including alloy elements such as Y and Sm dissolved in solid solution therein, the strength characteristic at 200° C. is about 135 MPa in terms of 0.2% proof stress (about 200 MPa for tensile strength), and the elongation characteristic is about 11.0%. Both are remarkably low. Such a material naturally cannot be hot-worked because of its low elongation. Further, the specimen in Examples of the Patent Document 3 is merely a casting material not subjected to hot working. At 200° C., for the magnesium alloys including alloy elements such as Y dissolved in solid solution therein, the elongation is about 15.5% in the case of the highest elongation, and the 0.2% proof stress is about 145 MPa (about 220 MPa for tensile strength). Therefore, in Examples of the Patent Document 3, the excellent strength and the excellent elongation at high temperatures cannot be made compatible with each other.

In contrast, the magnesium alloy of the present invention exhibits a tensile strength of 200 MPa or more and an elongation of 20% or more upon undergoing a tensile test at 250° C. due to the combination of the two specific solid solution elements of Y and Sm. Therefore, in accordance with the present invention, it is possible to obtain mechanical characteristics including both excellent strength and excellent elongation at high temperatures. The difference between Examples of the Patent Document 3 and the present invention arises from the difference in the included Y and Sm solute contents in the magnesium matrix, and the difference in mean crystal grain size of the structure. In the present invention, the included Y and Sm are not crystallized (precipitated) as intermetallic compounds into the grain boundary, but substantially or positively (forcibly) dissolved in solid solution in the magnesium matrix.

With conventional technologies including the Patent Document 3, even when a magnesium alloy includes Y and Sm, ensuring of the solute contents in the magnesium matrix cannot be made compatible with refinement of the crystal grain size. In order to increase the Y and Sm solute contents in the magnesium matrix as with the regulations of the present invention, it becomes essential to perform a solid solution treatment for positively dissolving Y and Sm in solid solution therein. In the Patent Document 3, the sample is subjected to tests of characteristics in the as-cast material state, and is not subjected to a solution treatment. The included Y and Sm are also dissolved in solid solution in the magnesium matrix during casting. However, due to the limit of the production steps such as the limit of the cooling rate during casting, there is a large limit on the solute content. Therefore, Y and Sm are mostly crystallized as intermetallic compounds at the grain boundary eventually as in the prior art. Accordingly, the Y and Sm solute contents do not become large as the regulation of the present invention. For this reason, in the Patent Document 3, although there is a description that Y, Sm, and the like are dissolved in solid solution, the Y and Sm solute contents cannot be ensured as much as the regulation of the present invention, and inevitably largely fall short of the regulation of the present invention. This is the reason why the magnesium alloy of the Patent Document 3 cannot have both the excellent strength and the excellent elongation at high temperatures although it includes Y and Sm.

When the solution treatment for positively dissolving Y and Sm in solid solution therein is performed, the Y and Sm solute contents can be ensured as with the regulation of the present invention. However, when such a solution treatment is performed, the crystal grain size is coarsened, and the mean crystal grain size of the structure increases in excess of the range of 3 to 30 μm of the regulation of the present invention. Therefore, even when Y and Sm are dissolved in solid solution therein, and the Y and Sm solute contents can be increased as with the regulation of the present invention, the mean crystal grain size of the structure increases in excess of the range of the regulation of the present invention. Accordingly, the excellent strength and the excellent elongation at high temperatures cannot be made compatible with each other as expected.

In contrast, in order to increase the Y and Sm solute contents as with the regulation of the present invention, and to refine the mean crystal grain size of the structure within the range of the regulation of the present invention, it is necessary to perform hot working after the solution treatment. Namely, after casting of a magnesium alloy including Y and Sm, the magnesium alloy is required to be subjected to a solution treatment, and further is formed into a desirable shape by hot working. Only when such a production process is adopted, it is possible to make compatible the ensuring of the Y and Sm solute contents and the refinement of crystal grain size, and to obtain mechanical characteristics including both the excellent strength and the excellent elongation at high temperatures.

In the present invention, the ingot after casting is previously subjected to a solution treatment. Y and Sm to be included are dissolved in solid solution in an amount only enough to ensure the elongation at the high temperatures, in a substantial amount as with the regulation of the present invention in the magnesium matrix. Further, hot working is performed for refinement of the crystal grain size. As a result, the high-temperature strength of the magnesium alloy after the solution treatment is improved, and the elongation at high temperatures is improved. Thus, the hot workability can be ensured.

Further, in the present invention, portions of Y and Sm to be included are dissolved in solid solution therein. On the other hand, the remaining portions of Y and Sm to be included are not precipitated at the grain boundary as in the prior art, but precipitated as precipitates in the magnesium crystal grains. As a result, the number of precipitates in the magnesium crystal grains can be ensured, resulting in an improvement of the creep characteristics at high temperatures.

For this, after the solution treatment and hot working, an ageing treatment is further performed. As a result, Y and Sm are precipitated as precipitates in the magnesium crystal grains. This can ensure the number of precipitates in the crystal grains. Without such a synthetic ageing treatment, it is not possible to ensure the number of precipitates of Y and Sm in the magnesium crystal grains enough to improve the creep characteristics at high temperatures.

As described up to this point, in the present invention, portions of Y and Sm to be included are dissolved in solid solution in the matrix, and the remaining portions thereof are precipitated in the crystal grains. This establishes the balance of both the solid solution and precipitation of Y and Sm to be included. This and the refinement of crystal grains improve the strength and elongation at high temperatures, which further improves the creep characteristics at high temperatures.

BEST MODE FOR CARRYING OUT THE INVENTION (Component Composition of Magnesium Alloy)

The magnesium alloy of the present invention aims to be excellent in high-temperature strength and hot workability, and preferably to exhibit a tensile strength of 200 MPa or more, and an elongation of 20% or more when the magnesium alloy is subjected to a tensile test at 250° C. In addition to these aims, the magnesium alloy of the present invention has a specific component composition in order to improve the creep characteristics at high temperatures.

In order to attain the aims, the magnesium alloy of the present invention includes Y: 1.8 to 8.0 mass %, and Sm: 1.4 to 8.0 mass %, respectively, and the balance being Mg and inevitable impurities, in which the Y and Sm solute contents in the magnesium matrix are Y: 0.8 to 4.0 mass % and Sm: 0.6 to 3.2 mass %, respectively.

Y: 1.8 to 8.0 Mass %

Y coexists with Sm to ensure the high-temperature strength and high-temperature elongation of the magnesium alloy. When the Y content is as too small as less than 1.8 mass %, it is not possible to ensure 0.8 mass % of the lower limit for ensuring the excellent high-temperature strength and the high-temperature elongation in terms of Y solute content in the magnesium matrix. Further, in this case, it is also not possible to ensure a number of precipitates of 160 precipitates/$\mu m^2$ of the lower limit in the crystal grains for ensuring the creep characteristics at high temperatures. On the other hand, when the Y content is as too large as more than 8.0 mass %, the amount of Y-based intermetallic compounds to be crystallized into the grain boundary increases. This rather reduces the high-temperature strength and the high-temperature elongation. Whereas, even when the Y content is as large as more than 8.0 mass %, the Y solute content in the magnesium matrix does not exceed 5.0 mass %. Therefore, Y is also not required to be included in a larger amount than that.

Sm: 1.4 to 8.0 mass

Sm coexists with Y to ensure the high-temperature strength and high-temperature elongation of the magnesium alloy. When the Sm content is as too small as less than 1.4 mass %, it is not possible to ensure 0.6 mass % of the lower limit for ensuring the excellent high-temperature strength and the high-temperature elongation in terms of Sm solute content in the magnesium matrix. Further, in this case, it is also not possible to ensure a number of precipitates of 160 precipitates/$\mu m^2$ of the lower limit in the crystal grains for ensuring the creep characteristics at high temperatures. On the other hand, when the Sm content is as too large as more than 8.0 mass %, the amount of Sm-based intermetallic compounds to be crystallized into the grain boundary increases. This rather reduces the high-temperature strength and the high-temperature elongation. Whereas, even when the Sm content is as large as more than 8.0 mass %, the Sm solute content in the magnesium matrix does not exceed 4.0 mass %. Therefore, Sm is also not required to be included in a larger amount than that.

(Y and Sm Solute Contents)

The Y and Sm solute contents in the magnesium matrix are set at Y: 0.8 to 4.0 mass %, and Sm: 0.6 to 3.2 mass %, respectively. When the Y and Sm solute contents are as too small as less than the lower limit, the excellent high-temperature strength and the high-temperature elongation cannot be ensured. On the other hand, in the present invention, it is necessary to ensure the number of precipitates in the crystal grains of Y and Sm. Therefore, even when a solution treatment is performed, it is difficult for the Y and Sm solute contents to exceed their respective upper limits. The effect thereof is also saturated. Further, in order to increase the Y and Sm solute contents, the solution treatment is increased in temperature and time. This results in remarkable coarsening of the crystal grain size. Thus, there is a high possibility that the crystal grains cannot be refined even by the subsequent hot working.

(Solute Content Measurement)

In order to measure the Y and Sm solute contents, first, a sample is collected from the manufactured final magnesium alloy (such as rod or sheet) to manufacture a thin-film sample for TEM observation by electrolytic polishing. Then, for this sample, an image is obtained at a magnification of ×300000 times by means of, for example, a HF-2200 field-emission type transmission electron microscope (FE-TEM) manufactured by Hitachi, Ltd. Then, for the image, a component quantitative analysis is performed by means of, for example, an NSS energy dispersion type analyzer (EDX) manufactured by Noran Co. Thus, the precipitates (intermetallic compounds) precipitated (crystallized) into the grain boundary and the insides of the grains of magnesium are omitted from the measurement objects. Thus, the Y and Sm solute contents in the magnesium matrix are determined.

(Precipitates of Y and Sm)

For the precipitates of Y and Sm in the crystal grains of magnesium, precipitates with a diameter of 2 nm or more in the observation under a TEM of a magnification of 300000 times are allowed to be present in a density of 160 precipitates/$\mu m^2$ or more on the average. When the number of precipitates of Y and Sm is as too small as less than the lower limit, the creep characteristics at high temperatures cannot be improved. On the other hand, in the present invention, portions of Y and Sm are dissolved in solid solution as described above. Therefore, even when an ageing treatment is performed, there is naturally a limit on the upper limit of the amount of precipitates in the crystal grains due to the relation with the solute contents.

(Precipitate Measurements)

In order to measure the number of intragrain precipitates in the crystal grains, first, a sample is collected from the manufactured final magnesium alloy (such as rod or sheet) to manufacture a thin-film sample for TEM observation by electrolytic polishing, ion sputtering, or the like. Then, for this sample, an image is obtained at a magnification (300000 times) by means of, for example, a HF-2200 field-emission type transmission electron microscope (FE-TEM) manufactured by Hitachi, Ltd. Then, for the image, a component quantitative analysis is performed by means of, for example, an NSS energy dispersion type analyzer (EDX) manufactured by Noran Co. Thus, the precipitates (intermetallic compounds) precipitated in the insides of the crystal grains of magnesium are identified. Thus, the number of precipitates having a size of 2 nm or more in diameter is measured. Then, averaging is performed into the number per 1 $\mu m^2$ (precipitates/$\mu m^2$) with the measured visual field area in the crystal grain, and the measured number of samples N (e.g., N=5). Incidentally, in the present invention, the number of precipitates is assumed to be the number per unit area (/$\mu m^2$) of the sample. The number was not converted into the number (density) per unit volume (/$\mu m^3$) in view of the film thickness t (about 0.1-mm thin film) of the sample for observation and transmission by the TEM.

In TEM observation for measurements of the solute contents and precipitates, the measurement sites of the magnesium alloy or the magnesium alloy formed products do not particularly matter. However, it is preferable that the measurement sites are the same. For example, when the measurement object is in the round column (cylinder) shape having a diameter D, the measurement site is preferably a given portion located within the region of ¼·D to ½·D from the circumferential surface and the bottom surface of the round column, respectively. Alternatively, when the measurement object is in the shape of a sheet or a prism having a thickness t, the measurement site is preferably located within the region of ¼·t to ½·t from respective surfaces.

(Structure)

In the present invention, based on the alloy compositions up to this point as the premise, the mean crystal grain size of the magnesium alloy structure is refined within the range of 3 to 30 μl. As a result, the strength and elongation at high temperatures of the magnesium alloy are further improved. In the case where the mean crystal grain size exceeds 30 μm even when the Y and Sm solute contents are ensured, the strength and elongation at high temperatures of the magnesium alloy are reduced. Further, it is difficult with the ability of the existing hot working process including hot hydrostatic extrusion and general hot extrusion to set the mean crystal grain size of the magnesium alloy structure at 3 μm or less.

(Mean Crystal Grain Size Measurement Process)

The crystal grain size referred to in the present invention denotes the maximum diameter of the crystal grain in the magnesium alloy material structure after hot working including extrusion. The crystal grain size is measured in the following manner: a magnesium alloy material is mechanically polished by 0.05 to 0.1 mm, followed by electrolytic etching; the resulting surface is observed by means of an optical microscope, and measured along the direction of extrusion or the longitudinal direction of the magnesium alloy material with the line intercept process. One measurement line length is set at 0.2 mm. Thus, a total of five visual fields are observed with three lines per visual field. Therefore, the overall measurement line length is 3 mm of 0.2 mm×15.

(Production Process)

Below, a description will be given to the preferred production process and conditions for obtaining the magnesium alloy of the present invention.

In the present invention, after casting of an ingot of a magnesium alloy molten metal adjusted to a specific component composition, the following steps are performed: mechanical working into a billet for hot working the ingot, if required; a solution treatment for dissolving Y and Sm in solid solution; and hot working such as extrusion for crystal grain refinement. In general production steps of a magnesium alloy, these production process is generally not performed. The as-cast ingot is used as a product, or this is only subjected to a heat treatment such as a solution treatment.

The solution treatment of the magnesium alloy is preferably performed at a solution treatment temperature of 50 to 550° C. for 5 to 30 hours. The more preferable solution treatment temperature is 500 to 550° C. When this temperature is too low, or when the time is too short, the Y and Sm solute contents may be insufficient. On the other hand, when the temperature is too high, or when the time is too long, crystal grains may be coarsened.

The hot working temperature of hot hydrostatic extrusion or general hot extrusion is preferably 350 to 550° C. The more preferable hot working temperature is 400 to 500° C. In the case where the hot working temperature is less than 350° C., even when the elongation at high temperatures is high, hot working is difficult. Whereas, when the hot working temperature is as high as more than 550° C., the mean crystal grain size cannot be refined. The working amount (working ratio) with hot working such as extrusion ratio or reduction ratio is set at an amount enough to provide a large number of crystal grain nucleus formation sites due to application of a strain, and to allow refinement of the mean crystal grain size of the magnesium alloy structure within the range of 3 to 30 μm.

Then, the magnesium alloy formed product formed into a prescribed product shape by the hot working is further subjected to an ageing treatment at a temperature of 150 to 300° C. As a result, precipitates with a diameter of 2 nm or more in the observation under a TEM of a magnification of 300000 times are precipitated in a density of 160 precipitates/$\mu m^2$ or more on the average in the crystal grains. It is naturally understood that, also in this ageing treatment, the following other requirements are held: the mean crystal grain size of the magnesium alloy structure is set within the range of 3 to 30 μm; and the Y and Sm solute contents in the magnesium matrix are set within the ranges of Y: 0.8 to 4.0 mass %, and Sm: 0.6 to 3.2 mass %, respectively. To this end, the ageing treatment is performed within the foregoing temperature range. When the temperature is too low, it is not possible to precipitate a prescribed number or more of precipitates. Whereas, when the temperature is too high, the crystal grain size is coarsened, or the Y and S solute contents are increased. This rather makes it impossible to precipitate a prescribed number or more of precipitates.

Below, the present invention will be described more specifically by way of examples. However, the present invention is not limited by the following examples. The present invention can naturally be put into practice by adding appropriate changes within the scope applicable to the gists described above and later. All of these are included in the technical scope of the present invention.

EXAMPLES

Below, Examples of the present invention will be described. By changing the magnesium alloy composition and production process, particularly the solution treatment conditions and the hot working conditions, and further, variously changing the Y and Sm solute contents in the magnesium alloy structure, the crystal grain size, and the like, the characteristics such as strength and elongation at high temperatures of each resulting magnesium alloy were evaluated, respectively.

Specifically, magnesium alloys of chemical component compositions shown in Table 1 were molten in an electric melting furnace under an argon inert atmosphere, respectively. Each molten metal was casted in a book mold made of cast iron at a temperature of 750° C., resulting in a magnesium alloy ingot with a diameter of 95 mm and a length of 100 mm. Then, the surface of each ingot was subjected to facing by mechanical working, resulting in a magnesium alloy billet with a diameter of 68 mm and a length of 100 mm.

The respective billets were each subjected to a solution treatment under their respective temperature conditions shown in Table 1 commonly for 10 hours. Then, extrusion was started at the solution treatment temperature. In addition, hot hydrostatic extrusion working of extrusion under extrusion ratio conditions shown in Table 1 was performed. As a result, round-bar-shaped (round column) specimens were obtained. The wall thickness (diameter) varies according to the extrusion ratio. At an extrusion ratio of 10, the diameter was 22 mm. Then, after the extrusion forming, an ageing treatment was performed. Incidentally, in Comparative Examples, there were also carried out examples in which the solution treatment or the hot hydrostatic extrusion working, and further the ageing treatment were not performed.

In all of respective examples, using samples cut out from the specimens of the magnesium alloy extrusion materials thus produced, the mean crystal grain size of the magnesium alloy structure, the mean number of precipitates, the Y and Sm solute contents in the magnesium matrix, and the like were measured, respectively.

Further, by the high-temperature tensile test at 250° C., the strength and elongation at this temperature, and the minimum creep speed at 200° C. were measured, respectively. Thus, the high-temperature characteristics as a member were evaluated. These results are shown in Table 1.

Herein, in each magnesium alloy shown in Table 1, the balance composition except for the described element contents is Mg except for trace amounts of components such as oxygen, hydrogen, and nitrogen. Incidentally, "–" shown in each element content of Table 1 denotes the identification limit or lower.

(Solute Content Measurement)

The solute contents of Y and Sm of each produced magnesium alloy extrusion material were measured by component quantitative analysis using the FE-TEM and the E-DX. A given five sites of the same specimen were measured, and a mean value thereof was adopted.

(Mean Crystal Grain Size Measurement Method)

The crystal grain size of each produced magnesium alloy extrusion material was measured with the line intercept method. A given five sites of the same specimen were measured, and a mean value thereof was adopted.

(Mean Number of Precipitates)

The mean number of precipitates in crystal grains of each produced magnesium alloy extrusion material was determined in the following manner. As described above, the sample structure for measurement collected from a portion located at a position of ¼·D from respective surfaces of the round-column magnesium alloy was observed by a TEM of a magnification of 300000 times. Thus, the number of precipitates with a diameter of 2 nm or more was measured. Then, averaging was performed into the number of precipitates per 1 $\mu m^2$ (precipitates/$\mu m^2$) with the measured visual field area in the crystal grains and the measured number of samples (N=5). Using a "H-800 transmission electron microscope (TEM): Hitachi Ltd." as a TEM, observation was carried out at an acceleration voltage of 200 KV. Further, in all of respective examples, the surface of each sample for measurement collected as described above was mechanically polished, followed by precision polishing. Further, ion sputtering was performed, thereby to form each sample. The calculation of the mean number of precipitates with the size was carried out by image analyzing the visual field of the TEM. As the image analysis software, "Image Pro Plus" manufactured by MEDIA CYBERNETICS Co., was used.

(Creep Characteristics)

In all of respective examples, using the samples for measurement collected from a magnesium alloy, the known constant-load creep test was performed. In view of the working conditions of the magnesium alloy, the set temperature was 200° C. Then, the applied load was set at 80 MPa. Thus, a creep test until 200 hours was carried out to determine the creep characteristics (minimum creep speed). At high temperatures, only application with a given load allows the deformation of the magnesium alloy to proceed. Therefore, the smaller the minimum creep speed indicating the deformation amount or the strain amount is, the more excellent the creep characteristics are. As the structural material for the respective uses, at a temperature of 200° C., a sample exhibiting a minimum creep speed of $1.5\times10^{-3}$ (1.5E-03) %/h or less is evaluated as acceptable in terms of creep characteristics.

(Tensile Test)

The tensile test at high temperatures was carried out using a specimen with the longitudinal direction as the extrusion direction by means of a 5882 model Instron universal testing machine. Under the conditions of 250° C., a test speed of 0.2 mm/min, and GL=6 mm, the strength (tensile strength, 0.2% proof stress: MPa) at high temperatures, and the elongation at high temperatures (total elongation) were measured. As each of the values, the mean value of the results obtained by testing three specimens under the same conditions was adopted.

As apparent from Table 1, for Inventive Examples 1 to 8, the contents of Y and Sm fall within the inventive composition, and the solution treatment temperature and the extrusion ratio of hot hydrostatic extrusion working, and further, the ageing treatment are within the preferable ranges. Thus, the product magnesium alloys are obtained. Accordingly, for the structure of each inventive example, the Y and Sm solute contents in the magnesium matrix with the respective measurement methods of the solute contents fall within the inventive composition. The mean crystal grain size of the magnesium alloy structure, and the mean number of precipitates in crystal grains also fall within the scope of the present invention.

As a result, for each inventive example, the tensile strength upon a tensile test at 250° C. is 200 MPa or more, the 0.2% proof stress is 150 MPa or more, and the elongation is 20% or more. Thus, the inventive example is excellent in strength and elongation at high temperatures. Further, for each invention example, the minimum creep speed is $1.5\times10^{-3}$ (1.5E-03)%/h or less. Thus, the inventive example is also excellent in creep characteristics. Therefore, it has been shown that the Inventive Examples 1 to 8 realize all of the excellent strength and elongation, and creep characteristics at high temperatures.

In contrast, Comparative Examples 9 to 13 are the same magnesium alloys within the inventive composition as with the inventive examples. However, the production conditions of the solution treatment, the hot hydrostatic extrusion working, and further, the ageing treatment, and the like depart therefrom. Out of these, Comparative Examples 9 and 11 are as-cast ingots not subjected to hot hydrostatic extrusion working (Comparative Example 9 has also not been subjected to a solution treatment). For Comparative Examples 10, 12, and 13, the production conditions of the solution treatment, the hot hydrostatic extrusion working, and further, the ageing treatment, and the like depart therefrom. Accordingly, for each structure of Comparative Examples 9 to 13, the Y and Sm solute contents in the magnesium matrix, the mean crystal grain size, or the mean number of precipitates in crystal grains depart from the scope of the present invention. As a result, any of the strength and elongation, or the creep characteristics at

TABLE 1

| | | Mg alloy component (balance Mg) | | Mg alloy production conditions | | | Mg alloy structure | | | | Mg alloy high-temperature characteristics | | | |
|---|---|---|---|---|---|---|---|---|---|---|---|---|---|---|
| Section | No. | Y mass % | Sm mass % | Solution treatment temperature ° C. | Hydrostatic extrusion ratio | Ageing treatment temperature × 24 h ° C. | Y solute content mass % | Sm solute content mass % | Mean crystal grain size μm | Mean number intragrain precipitates precipitates/$\mu m^2$ | Tensile strength MPa | 0.2% proof stress MPa | Total elongation % | Creep characteristics (200° C.) Minimum creep speed %/h |
| Inventive example | 1 | 5 | 5 | 520 | 10 | 200 | 3.8 | 2.0 | 20 | 590 | 264 | 193 | 28 | 8.60E−04 |
| | 2 | 5 | 5 | 500 | 10 | 200 | 3.7 | 1.9 | 18 | 560 | 241 | 178 | 23 | 8.60E−04 |
| | 3 | 5 | 5 | 520 | 3 | 200 | 3.8 | 2 | 28 | 590 | 253 | 186 | 25 | 1.07E−03 |
| | 4 | 7.2 | 7.2 | 500 | 10 | 220 | 4.0 | 2.2 | 19 | 680 | 277 | 201 | 20 | 7.66E−04 |
| | 5 | 1.8 | 5 | 520 | 10 | 220 | 0.9 | 2.1 | 22 | 380 | 202 | 154 | 32 | 1.28E−03 |
| | 6 | 7.2 | 5 | 520 | 10 | 220 | 4.0 | 2.0 | 20 | 650 | 273 | 198 | 20 | 1.11E−03 |
| | 7 | 5 | 1.6 | 520 | 10 | 220 | 3.8 | 0.8 | 22 | 470 | 228 | 169 | 28 | 1.46E−03 |
| | 8 | 5 | 7.2 | 520 | 10 | 220 | 3.8 | 2.2 | 20 | 620 | 269 | 197 | 22 | 1.32E−03 |
| Comparative example | 9 | 5 | 5 | — | — | 200 | 0.6 | 0.3 | 48 | 90 | 166 | 147 | 26 | |
| | 10 | 5 | 5 | 400 | 10 | 200 | 1.0 | 0.2 | 16 | 150 | 116 | 95 | 31 | |
| | 11 | 5 | 5 | 520 | — | 200 | 3.8 | 2 | 44 | 570 | 321 | 236 | 15 | |
| | 12 | 5 | 5 | 520 | 2 | 200 | 3.8 | 2 | 35 | 580 | 288 | 213. | 16 | |
| | 13 | 5 | 5 | 450 | 10 | 120 | 2.8 | 1.6 | 19 | 120 | 244 | 192 | 20 | 1.60E−03 |
| | 14 | 1.6 | 5 | 520 | 10 | 220 | 0.7 | 2.1 | 22 | 280 | 172 | 127 | 34 | |
| | 15 | 5 | 1.2 | 520 | 10 | 220 | 3.8 | 0.4 | 22 | 410 | 185 | 137 | 36 | |
| | 16 | 9 | 5 | 520 | 10 | 220 | 4.8 | 2 | 20 | 700 | 286 | 208 | 9 | |
| | 17 | 5 | 9 | 520 | 10 | 220 | 3.8 | 3.3 | 20 | 740 | 289 | 210 | 7 | |

high temperatures is inferior. This indicates that Comparative Examples 9 to 13 cannot realize the compatibility of the strength and elongation and the creep characteristics at high temperatures. Incidentally, of Comparative Examples 9 to 17, the samples inferior in evaluation of strength and elongation were not subjected to the measurement of the creep value. Therefore, in comparative examples, the sample whose creep value was measured is only Comparative Example 13.

Further, for Comparative Examples 14 to 17, the content of either of Y and Sm departs from the inventive composition. Therefore, although the production conditions of the solution treatment, the hot hydrostatic extrusion working, and further, the ageing treatment, and the like fall within the preferred scope, the Y and Sm solute contents in the magnesium matrix in the structure and the like depart from the inventive scope. This indicates that Comparative Examples 14 to 17 are insufficient in strength and elongation at high temperatures.

The results up to this point support respective critical significances of the inventive composition of Y and Sm, the solute contents thereof, the mean crystal grain size, and the number of precipitates in the inventive magnesium alloy for achieving the compatibility between the excellent strength and elongation, and the excellent creep characteristics at high temperatures, and the significance of balancing the solute contents and the number of precipitates. Further, the results also support the significances of hot working such as solution treatment and hot hydrostatic extrusion, and the significances of respective preferable conditions.

INDUSTRIAL APPLICABILITY

As described above, according to the present invention, there can be provided a magnesium alloy excellent in strength and elongation at high temperatures, i.e., high-temperature strength and hot workability, and further excellent in creep characteristics, and improved in reliability as a member, and a production process thereof. As a result, the magnesium alloy in accordance with the present invention is preferably applicable to structural materials of casings of electric/electronic devices, engine components (piston, connecting rod), and the like of cars, aircraft, and the like.

As described up to this point, the present invention was described specifically, and with reference to specific embodiments. However, it is apparent to those skilled in the art that various changes and modifications may be made without departing from the spirit and scope of the present invention. The present application is based on Japanese Patent Application (Japanese Patent Application No. 2008-095140) filed on Apr. 1, 2008, the contents of which are hereby incorporated by reference.

The invention claimed is:

1. A magnesium alloy, comprising Y: 1.8 to 8.0 mass %, and Sm: 1.4 to 8.0 mass %, and the balance being Mg and inevitable impurities, wherein Y and Sm solute contents in a magnesium matrix of the magnesium alloy are Y: 0.8 to 4.0 mass % and Sm: 0.6 to 3.2 mass %, mean crystal grain size of a magnesium alloy structure is from 3 to 30 μm, and in the crystal grains, precipitates with a diameter of 2 nm or more observed under a TEM of a magnification of 300000 times are present in an average density of 160 precipitates/$\mu m^2$ or more.

2. The magnesium alloy according to claim 1, wherein the magnesium alloy exhibits a tensile strength of 200 MPa or more and an elongation of 20% or more when the magnesium alloy is subjected to a tensile test at 250° C.

3. The magnesium alloy according to claim 1, wherein the magnesium alloy has been subjected to a solution treatment after casting, formed into a prescribed shape by hot working, and subjected to an ageing treatment.

4. A process for producing a magnesium alloy, the process comprising:

casting a magnesium alloy molten metal comprising Y: 1.8 to 8.0 mass %, and Sm: 1.4 to 8.0 mass %, respectively, and the balance being Mg and inevitable impurities;

after the casting, performing a solution treatment at a temperature of 450 to 550° C.;

after the solution treatment, performing hot working at a temperature of 350 to 550° C. for formation into a prescribed product shape;

performing an ageing treatment at a temperature of 150 to 300° C.;

setting the Y and Sm solute contents in the magnesium matrix of the resulting magnesium alloy formed product structure at Y: 0.8 to 4.0 mass % and Sm: 0.6 to 3.2 mass %;

setting the mean crystal grain size of the magnesium alloy structure within the range of 3 to 30 μm; and allowing precipitates with a diameter of 2 nm or more observed under a TEM of a magnification of 300000 times to be present in an average+density of 160 precipitates/$\mu m^2$ or more in the crystal grains.

5. The magnesium alloy according to claim 1, comprising Y: 1.8 to 5.0 mass %.

6. The magnesium alloy according to claim 1, comprising Y: 1.8 to 7.2 mass %.

7. The magnesium alloy according to claim 1, comprising Sm: 1.4 to 5.0 mass %.

8. The magnesium alloy according to claim 1, comprising Sm: 1.6 to 7.2 mass %.

9. The magnesium alloy according to claim 1, wherein the Y and Sm solute contents in the magnesium matrix are Y: 0.8 to 3.8 mass % and Sm: 0.6 to 2.2 mass %.

10. The magnesium alloy according to claim 1, wherein the Y and Sm solute contents in the magnesium matrix are Y: 0.9 to 3.7 mass % and Sm: 0.8 to 1.9 mass %.

11. The magnesium alloy according to claim 1, wherein the mean crystal grain size of the magnesium alloy structure is from 3 to 19 μm.

12. The magnesium alloy according to claim 1, wherein the mean crystal grain size of the magnesium alloy structure is from 3 to 28 μm.

13. The magnesium alloy according to claim 1, wherein in the crystal grains, precipitates with a diameter of 2 nm or more observed under a TEM of a magnification of 300000 times are present in an average density of 160 to 380 precipitates/$\mu m^2$.

14. The magnesium alloy according to claim 1, wherein in the crystal grains, precipitates with a diameter of 2 nm or more observed under a TEM of a magnification of 300000 times are present in an average density of 160 to 560 precipitates/$\mu m^2$.

15. The magnesium alloy according to claim 1, wherein in the crystal grains, precipitates with a diameter of 2 nm or more observed under a TEM of a magnification of 300000 times are present in an average density of 160 to 650 precipitates/$\mu m^2$.

* * * * *